US005238484A

United States Patent [19]

Pirklbauer et al.

[11] Patent Number: 5,238,484

[45] Date of Patent: Aug. 24, 1993

[54] PLANT FOR THE PRODUCTION OF MOLTEN METALS AND METHOD

[75] Inventors: Wilfried Pirklbauer, Niederneukirchen; Alfred Weber, Luftenberg; Johannes Steins, Gallneukirchen, all of Austria

[73] Assignee: Voest-Alpine Industrianlagenbau GmbH, Linz, Austria

[21] Appl. No.: 793,640

[22] Filed: Nov. 18, 1991

[30] Foreign Application Priority Data

Nov. 19, 1990 [AT] Austria ..... 2332/90

[51] Int. Cl.[5] ..... C21B 13/14

[52] U.S. Cl. ..... 75/414; 75/560; 75/573; 75/584; 75/10.61; 266/45; 266/236; 266/165; 266/900

[58] Field of Search ..... 266/275, 236, 45, 165, 266/200, 900, 901; 75/414, 560, 573, 584, 10.61

[56] References Cited

U.S. PATENT DOCUMENTS 4,083,715 4/1978 Langhammer ..... 75/10.63

4,869,388 9/1989 Race ..... 266/275

FOREIGN PATENT DOCUMENTS

0321443A2 6/1989 European Pat. Off. .

0199714B1 10/1989 European Pat. Off. .

2450495 4/1975 Fed. Rep. of Germany .

*Primary Examiner*—Melvyn J. Andrews

*Attorney, Agent, or Firm*—Hopgood, Calimafde, Kalil, Blaustein & Judlowe

[57] ABSTRACT

A plant for the production of molten metals, includes a melting vessel and a metallurgical vessel receiving the melt from the melting vessel for aftertreating the melt and closed by a lid. The melting vessel has a tap opening for the melt provided on the bottom level of the melting vessel and located on the periphery of the melting vessel. The tap opening is positioned above a pour-in opening of the metallurgical vessel. In order to ensure a continuous melting procedure, the pour-in opening of the metallurgical vessel following the melting vessel is provided above a melt guiding chute arranged within the metallurgical vessel.

22 Claims, 1 Drawing Sheet

PLANT FOR THE PRODUCTION OF MOLTEN METALS AND METHOD

The invention relates to a plant for the production of molten metals, in particular of steel, comprising a melting vessel and a metallurgical vessel receiving the melt from the melting vessel for aftertreating the melt and closed by a lid, the melting vessel including a tap opening for the melt provided on the bottom level of the melting vessel and located at the periphery of the melting vessel, which tap opening is positioned above a pour-in opening of the metallurgical vessel, as well as to a method of producing metal melt.

A plant of this type is known from EP-A - 2 321 443. With the known plant, the melting vessel is designed as a tiltable converter smelting scrap and/or pig iron, whose oriel located on the bottom level is positioned above a ladle. With this plant, the production of molten metal takes place continuously, yet it is necessary to tilt the converter during a ladle exchange until the tap opening is located above the melt level such that the continuous tapping procedure and the melting procedure are interrupted.

From EP-B1 - 0 199 714 a plant is known, by which sponge iron is smelted in an electric furnace and the melt is poured through a cantilevering tapping spout into a ladle, in which further treatment of the melt, such as dephosphorization and the addition of alloying components, takes place. In this case, melting and aftertreating are effected discontinuously. With both known plants, a large falling height is involved in tapping the melt.

Other problems faced in known plants go back to the gases incurred in the metallurgical vessel in a possible aftertreatment of the melt, which have to be removed via separate suction means.

The invention aims at avoiding these disadvantages and difficulties and has as its object to provide a plant of the initially defined kind as well as a method of operating this plant, with which the melting procedure may be realized continuously irrespective of any additional treatment of the melt and with which a defined mixing effect within the melt bath contained in the metallurgical vessel is feasible due to the melt intake being free from splashes to the greatest extent possible.

In accordance with the invention, this object is achieved in that the pour-in opening of the metallurgical vessel following the melting vessel is provided above a melt guiding chute arranged within the metallurgical vessel.

Suitably, the melt guiding chute is inclined in the region of contact with the melt entering the metallurgical vessel, the melt flow emerging from the melting vessel being directed towards the melt guiding chute at an acute angle such that the melt impinging on the melt guiding chute is received by the melt guiding chute substantially free of splashes.

According to another preferred embodiment, the melt guiding chute, at least in the lower region, is designed to be curved or bent towards the center of the metallurgical vessel in the longitudinal direction by decreasing in inclination, whereby the kinetic energy of the melt flow of the newly entering melt is caused to definedly mingle with the melt present already within the metallurgical vessel without too intensive a whirling motion occurring.

A structurally simple configuration is characterized in that the melt guiding chute is integral with the side wall of the metallurgical vessel, the pour-in opening of the metallurgical vessel suitably protruding beyond the periphery of the metallurgical vessel.

In this case, the melt guiding chute advantageously is designed as a structural component cantilevering beyond the periphery of the metallurgical vessel and departing from the pour-in opening in a manner that the furnace interior is not affected by the melt guiding chute.

In order to avoid separate gas evacuation ducts from the metallurgical vessel and the pertaining pipework, the tap hole of the metallurgical vessel advantageously is provided in an oriel laterally cantilevering from the melting vessel and has a cross section larger than the cross section of the melt flow emerging from the melting vessel, the tap opening closely following upon the pour-in opening of the metallurgical vessel.

Suitably, both the tap hole and the melt guiding chute are lined with a highly wear-resisting material, such as ceramics, so that these parts are worn to the same extent as the remaining plant components and no additional exchange is required.

In order to safeguard the stability of temperature within the melt guiding chute at any operational event and period, i.e., even in the starting phase, at least one burner advantageously is provided in the region of the tap opening pour-in opening, which burner is directed towards the melt guiding chute.

To introduce fluxes into the metallurgical vessel under good mingling with the melt, the plant suitably is equipped with a flux charging means directed towards the melt guiding chute, a preferred embodiment being characterized in that the flux charging means is designed as a supply pipe arranged in the lid of the metallurgical vessel and directed towards the melt guiding chute.

In order to avoid gas from penetrating out of the plant and to ensure the perfect gas transfer from the metallurgical vessel into the melting vessel, a seal advantageously is provided between the tap opening of the melting vessel and the pour-in opening of the metallurgical vessel, which seal suitably is designed as a seal insert to be inserted from outside, which surrounds the tap opening and rests on the upper end of the melt guiding chute.

A preferred embodiment is characterized in that the seal insert is designed like a horseshoe and adapted to the upper end of the melt guiding chute.

The seal is insertable in a simple manner if the seal insert has a wedge-shaped cross section tapering towards the interior of the metallurgical vessel and whose relatively inclined surfaces abut on corresponding counter surfaces of the melting vessel and of the upper end of the melt guiding chute.

In order to enable the simple assembly of the plant as well as the simple maintenance of the same, the melting vessel advantageously is designed in two parts, comprising a stationary shaft part and a bottom part liftably and lowerably supported on a displaceable car, in which the tap opening is provided, wherein suitably at least one plane of burners is provided in the bottom part and at least one plane of burners is provided in the shaft part.

In order to exclude overheating of the burners arranged in the bottom part and of the brickwork surrounding the same, the bottom part advantageously is designed like a pot and the side wall rising laterally from its bottom is designed to taper upwardly at least in the partial region in which the burners are provided, the inclination of these partial regions of the side wall being slighter than the inclination of the side wall following upon this side wall upwards.

An advantageous process for the production of metal melt, in particular of steel, by the plant according to the invention is characterized in that the melt is continuously conveyed into the metallurgical vessel from the melting vessel and is discontinously drawn off the metallurgical vessel after a refining treatment.

In doing so, a definedly good mingling of the melt entering the metallurgical vessel with the melt already present within the metallurgical vessel is effected by allowing the melt to stream into the melt sump present within the metallurgical vessel from the marginal region and in a manner directed approximately towards the center.

Advantageously, the gases forming in the metallurgical vessel are withdrawn from the metallurgical vessel through the tap opening in countercurrent to the melt flow and are introduced into the melting vessel, the thermal content of the withdrawn gases being beneficial to the charging stock introduced into the melting vessel immediately and almost lossfree.

On account of the addition of fluxes to the melt flow as the latter passes the melt guiding chute, thorough mingling of the fluxes with the melt present in the metallurgical vessel is ensured.

To safeguard the stability of temperature and to avoid freezing of the melt guiding chute, the melt flow is heated as it passes the melt guiding chute.

In the following, the invention will be explained in more detail by way of an exemplary embodiment illustrated in the accompanying drawing, wherein:

FIG. 1 sectionally illustrates a plant for the production of steel;

Figure 2:
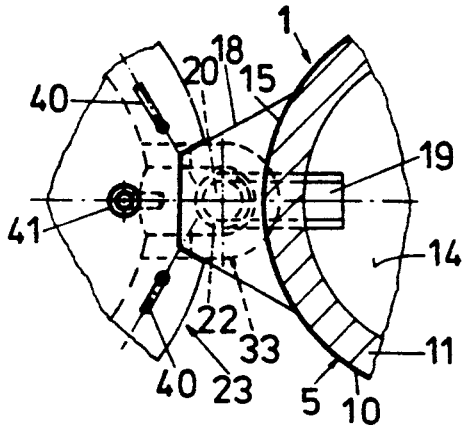
FIG. 2 represents a section along line II-II of FIG. 1.
Figure 3:
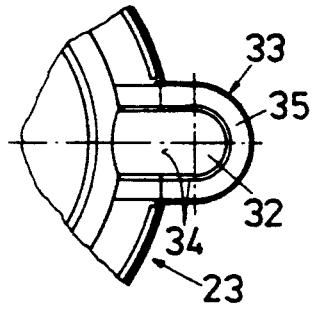
FIG. 3 represents a section along line III-III of FIG. 1.
Figure 1:
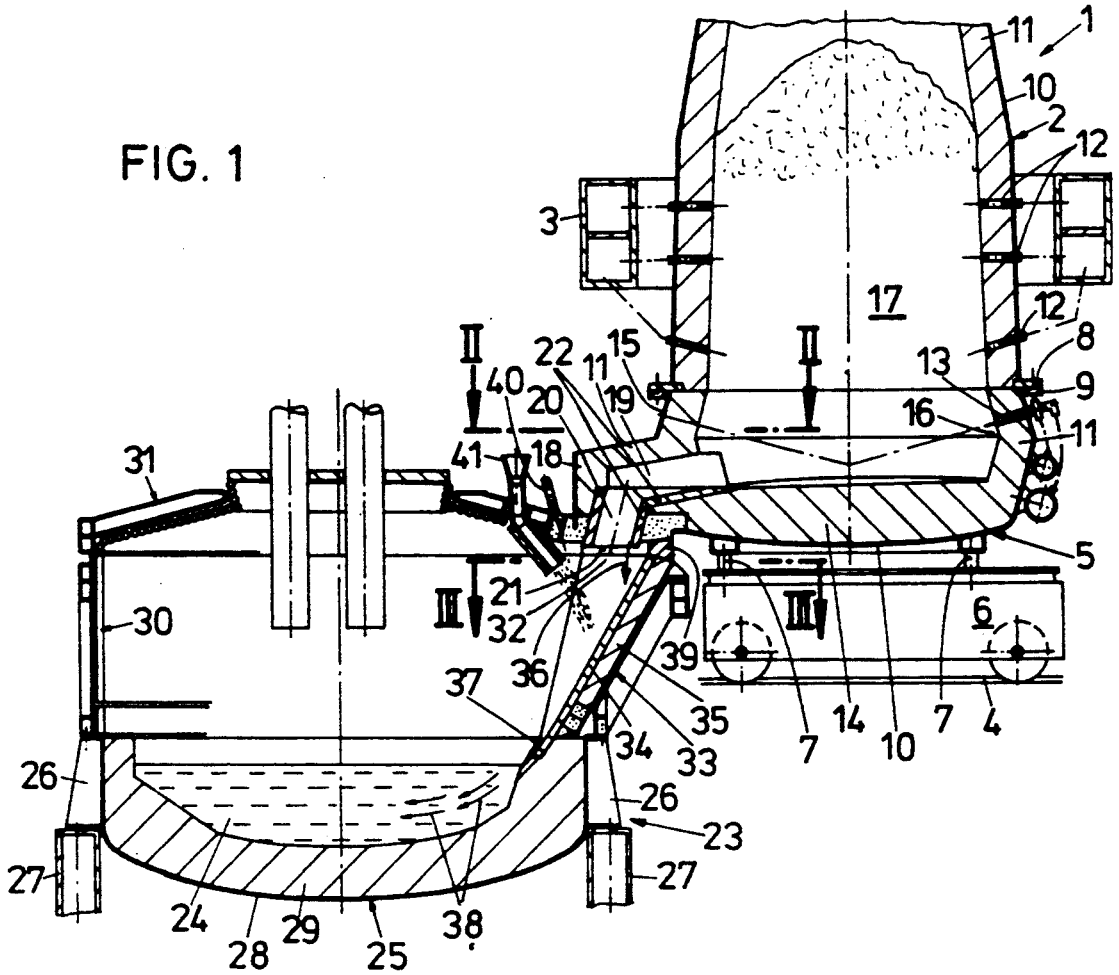

A stationarily supported melting vessel 1 is composed of two parts, i.e., an upper part constituting a shaft part 2 of the melting vessel, which is stationarily fastened to a platform 4 via a hollow frame 3 annularly surrounding this part, and a bottom part 5 resting on a car 6 displaceable, on the platform 4. This bottom part 5 is supported on the car 6 so as to be displaceable in height by a lifting means 7, and may be moved towards the shaft part 2 by the lifting means. The connection between the bottom part 5 and the shaft part 2 is effected via flanges 8, 9 provided on the abutting end faces of these parts and joined by screwing.

Both the bottom part 5 and the shaft part 2 each comprise an external metal jacket 10 and are lined with a refractory lining 11 on their internal sides. Burners 12 and oxygen-containing-gas feeds are provided in the shaft part 2, passing its wall, preferably on two or more levels, whose supply ducts are led through the hollow frame 3. A charging means is arranged on the upper end of the shaft part (not illustrated).

In the bottom part 5, burners 13 are also provided on at least one level. The bottom part 5 of the shaft furnace 1 is designed like a pot, the plane of the burners 13 being in the side wall 15 of the bottom part 5, that rises from the bottom 14. At the level of the burners 13, this side wall 15 is designed like a cone tapering upwardly. The inclination of the side wall 15 at the height of the burners 13 is slighter than that of the wall of the melting vessel 1 following this side wall 15 upwards and formed by the shaft part 2 in the exemplary embodiment illustrated. Thus, a hollow or free space 16 is formed between the side wall 15 of the bottom part 5 comprising the burners 13 and the burden 17 contained in the melting furnace, which prevents the burners 13 and the refractory lining 11 surrounding the burners from getting overheated. The side wall 15 also could be designed in steps for the formation of the free space 16.

The bottom part 5 comprises an oriel 18 projecting laterally beyond the side wall 15, into which a discharge channel 19 enters, departing from the bottom 14 and arranged to be slightly downgrade and oriented radial. This discharge channel passes over into a channel portion 20 steeply oriented downwards, on whose end there is the tap opening 21. The refractory lining 11 of the shaft furnace 1 is continued in the oriel 18. The discharge channel is lined with highly wear-resisting material 22, such as ceramics.

Laterally beside the melting vessel 1 and at a level below the same, a metallurgical vessel 23, which is designed as an electric furnace, is arranged for refining the melt 24 streaming from the melting vessel 1 into the metallurgical vessel 23 through the tap opening 21. This vessel 23 has a curved bottom part 25, which is rigidly, i.e., immovably, supported on posts 27 stationarily arranged on the base, via brackets 26 or a frame. This bottom part 25 is formed by a metal external jacket 28 and a refractory lining 29 and includes tap holes for slag and steel melt as well as an auxiliary tap hole at the lowermost point of the vessel (not illustrated).

An annular side wall jacket 30 preferably comprised of water-cooled panels rests on the bottom part 25 of the metallurgical vessel 23 and is tightly closed by a lid 31 comprised of water-cooled pipes. Schematically illustrated electrodes project into the interior of the vessel 23 through openings of the lid 31.

The arrangement of the metallurgical vessel 23 relative to the melting vessel 1 is such that the side wall jacket 30 of the metallurgical vessel 23 comes to lie approximately vertically below the tap hole 21 of the melting vessel 1. In the region below the tap hole 21 of the melting vessel 1, the metallurgical vessel 23 is provided with an outwardly inclined melt guiding chute 33 defining a pour-in opening 32, which chute is lined with a layer of highly wear-resisting material 34, such as ceramics, resting on a lining of refractory material 35. The lining layer 34 terminates above the maximum height of the melt bath level.

The arrangement of the melt guiding chute 33 is such that the melt flow emerging from the melting vessel 1 and indicated by the arrow 36 impinges on the melt guiding chute 33 at an acute angle, the intake into the metallurgical vessel 23, thus, being ensured in a manner substantially free of splashes. The melt guiding chute 33 is curved or slightly bent on its lower end 37, the inclination of the melt guiding chute getting smaller towards its end. By using the kinetic energy of the melt flow 36, the defined deflection of the melt flow and, thus, good mingling of the newly incoming melt with the melt bath 24 present within the metallurgical vessel are thereby achieved, as is illustrated by arrows 38.

A seal 39 is fitted from outside between the upper end of the melt guiding chute 33 and the lower end of the oriel 18, having a wedge-shaped cross section tapering towards the interior of the metallurgical vessel 23 and sitting close at corresponding counter surfaces of the oriel and of the upper end of the melt guiding chute by its relatively inclined surfaces.

Burners 40 are provided in the lid 31 of the metallurgical vessel 23 in the region of the oriel or laterally extending porta 18, which burners are directed towards the melt guiding chute 33 and serve to heat the same, providing for a temperature stability such that no crusts will form in the melt guiding chute 33. Furthermore, at least one supply pipe 41 is provided in this region for the addition of fluxes, which passes through the lid 31 from top and likewisely directed to the melt guiding chute 33.

The metallurgical vessel 23 may be equipped with additional natural gas/$O_2$ burners, bottom flushing elements as well as openings for measuring lances or further fluxes.

Gases that form in the metallurgical vessel 23 preferably reach the melting vessel 1 directly preferably exclusively through the tap hole 21 and the discharge channel 19, 20, whose cross sections are substantially larger than the cross section of the melt flow 36 emerging from the melting vessel, pass the burden 17 contained in the same by releasing their thermal contents and are withdrawn on the upper end of the melting vessel via a gas evacuation means (not illustrated).

What We claim is:

1. A plant for producing molten metals comprising an upstanding melting vessel characterized by a downwardly extending shaft portion which terminates into a bottom for receiving metal melted in said melting vessel, said bottom having a tap opening at a peripheral portion thereof through which molten metal is removed, said plant including a metallurgical vessel having a roof or lid cooperatively coupled to the bottom of said melting vessel such that the tap opening of said bottom is disposed above and communicates with a pour-in opening located at a peripheral portion of the roof or lid of said metallurgical vessel, said vessel having a closed bottom, said metallurgical vessel including a melt-guiding chute having an upper end and a lower end disposed within said metallurgical vessel along an internal wall thereof extending downwardly from its upper end from a region of the pour-in opening of the metallurgical vessel with its lower end terminating above the bottom of said metallurgical vessel where the molten metal is subsequently confined for further metallurgical treatment.

2. The plant as set forth in claim 1, wherein said melt-guiding chute in said metallurgical vessel is inclined toward the interior and bottom of said vessel from a region of the pour-in opening to the bottom of said metallurgical vessel, such that the flow of molten metal from the tap opening into the metallurgical vessel through the pour-in opening thereof is directed towards said melt-guiding chute at an acute angle to said chute.

3. The plant as set forth in claim 1, wherein the guiding chute at its lower end is curved or bent as it approaches the bottom of the metallurgical vessel with decreasing inclination.

4. The plant as set forth in claim 1, wherein said guiding chute is integral with the internal wall of said metallurgical vessel along which the guiding chute extends to the bottom of said vessel.

5. The plant as in claim 1, wherein the pour-in opening of said metallurgical vessel projects beyond the periphery of said metallurgical vessel.

6. The plant as in claim 5, wherein the melt-guiding chute extends from the pour-in opening as a structural component cantilevered inwardly beyond the periphery of said metallurgical vessel.

7. The plant as set forth in claim 2, wherein the bottom of the melting vessel is characterized by a laterally extending portion cantilevered with respect to said bottom, said extending portion including said tap opening, said tap opening having a cross section larger than the cross section of melt flow discharged from said melting vessel, said tap opening communicating with the pour-in opening of said metallurgical vessel.

8. The plant as set forth in claim 1, wherein both said tap opening and said melt-guiding chute are lined with a wear and temperature resistant material.

9. The plant as set forth in claim 8, wherein said wear and temperature resistant material is a ceramic.

10. The plant as in claim 1, wherein at least one burner is provided in the region of the tap opening and the pour-in opening, said at least one burner being directed towards said melt-guiding chute.

11. The plant as set forth in claim 1, wherein a flux charging means is provided in the roof or lid of said metallurgical vessel directed towards said melt-guiding chute.

12. The plant as set forth in claim 11, wherein the flux charging means comprises a supply pipe directed to said melt-guiding chute.

13. The plant as set forth in claim 11, further comprising a seal provided between said tap opening of the melting vessel and said pour-in opening of said metallurgical vessel.

14. The plant as set forth in claim 13, wherein said seal comprises a seal insert externally insertable, said seal surrounding said tap opening and resting on the upper end of the melt-guiding chute in the region of the pour-in opening.

15. The plant as set forth in claim 14, wherein the seal insert has a wedge-shaped cross section tapering towards the interior of said metallurgical vessel and having relatively inclined surfaces which abut corresponding counter-surfaces of said melting vessel and which abut the upper end of said melt-guiding chute.

16. The plant as set forth in claim 11, wherein said melting vessel is a two-part melting vessel comprised of a stationary shaft part and a liftable and lowerable bottom part including said tap opening, said plant also including a displaceable car adapted to liftably and lowerably support said bottom part.

17. The plant as set forth in claim 16, comprising a set of burners cooperatively associated with said bottom part and at least one set of burners cooperatively associated with the shaft part.

18. A process for producing refined molten metal in a plant comprising an upstanding melting vessel characterized by a downwardly extending shaft portion which terminates into a bottom for receiving metal melted in said melting vessel, said bottom having a tap opening at a peripheral portion thereof through which molten metal is removed, said plant including a metallurgical vessel having a roof or lid cooperatively coupled to the bottom of said melting vessel such that the tap opening of said bottom is disposed above and communicates with a pour-in opening located at a peripheral portion of the roof or lid of said metallurgical vessel, said metallurgical vessel including a melt-guiding chute having an upper end and a lower end disposed within said metallurgical vessel along an internal wall thereof extending downwardly from its upper end from a region of the pour-in opening of the metallurgical vessel with its lower end terminating above the bottom of said metallurgical vessel where the molten metal is subsequently confined for further metallurgical treatment.

said process comprising continuously conveying said melt from said melting vessel via its tap opening into said metallurgical vessel through its pour-in opening, refining the molten metal in said metallurgical vessel, and then discontinuously drawing off the molten metal from the metallurgical vessel after the refining thereof.

19. The process as set forth in claim 18, wherein said metallurgical vessel has a melt sump, wherein the melt from melting vessel is caused to flow into said melt sump in a direction from the inner periphery of said metallurgical vessel toward approximately the central region thereof.

20. The process as set forth in claim 18, further comprising drawing off gases which form within said metallurgical vessel and through the tap opening of said melting vessel in a counterflow direction to the melt flowing through said tap opening into said metallurgical vessel, thereby introducing said gases into said melting vessel.

21. The process as set forth in claim 18, further comprising the step of introducing fluxes into said melt flow as it flows into the metallurgical vessel as it passes along said guiding chute.

22. The process as set forth in claim 18, further comprising heating said melt flow as it passes along said melt guiding chute.

* * * * *